United States Patent [19]

Imai et al.

[11] Patent Number: 4,902,147

[45] Date of Patent: Feb. 20, 1990

[54] PRINTING APPARATUS WITH A CARRIAGE AND A PRINTING MEANS HOLDER MOVABLE RELATIVELY TO THE SAME

[75] Inventors: Tatsuji Imai, Ichinomiya; Kazuo Nakamura, Iwakura, both of Japan

[73] Assignee: Brother Kogyo Kabushiki Kaisha, Nagoya, Japan

[21] Appl. No.: 140,757

[22] Filed: Jan. 4, 1988

[30] Foreign Application Priority Data

Jan. 6, 1987 [JP] Japan ..... 62-463[U]

[51] Int. Cl.[4] ..... B41J 1/30

[52] U.S. Cl. ..... 400/144.2; 400/356

[58] Field of Search ..... 400/144.2, 175, 320, 400/352, 353, 355, 356, 691, 692

[56] References Cited

U.S. PATENT DOCUMENTS

| | | | |
|---|---|---|---|
| 4,310,255 | 1/1982 | Asano et al. | 400/144.2 |
| 4,469,454 | 9/1984 | Crean | 400/175 |
| 4,514,100 | 4/1985 | LaSpesa | 400/353 |
| 4,705,416 | 11/1987 | Asakura | 400/144.2 |
| 4,710,045 | 12/1987 | Lim | 400/352 |
| 4,746,236 | 5/1988 | Shioda | 400/144.2 |

FOREIGN PATENT DOCUMENTS

| | | | |
|---|---|---|---|
| 6467 | 1/1985 | Japan | 400/144.2 |

*Primary Examiner*—David A. Wiecking

*Attorney, Agent, or Firm*—Jones, Tullar & Cooper

[57] ABSTRACT

A printing apparatus in which a holder, bearing a type carrier thereon, and a carriage, moving along a printing line, are coupled together by means of an engaging member and a coupling plate formed integrally with the holder and the carriage, respectively. The coupling plate has a surface extending along the transfer direction of the carriage and formed with an opening. The engaging member extends transverse to the carriage transfer direction so as to engage the opening. By this engagement, the holder is moved as one with the carriage, with respect to the carriage transfer direction. With respect to a direction transverse to the carriage transfer direction, the holder is allowed to move between a printable position, where the holder is situated close to a platen, and a retracted position, where the holder is situated wide apart from the platen.

10 Claims, 4 Drawing Sheets

PRINTING APPARATUS WITH A CARRIAGE AND A PRINTING MEANS HOLDER MOVABLE RELATIVELY TO THE SAME

BACKGROUND OF THE INVENTION

The present invention relates to a printing apparatus provided with printing means, a carriage, and a holder, the printing means including a type carrier, such as a type wheel, and type selection means, such as a character selector motor, the holder supporting the type wheel and/or the type selection means and being movable relatively to the carriage.

FIGS. 1 and 2 show a conventional printing apparatus of this type. In printing a character or the like on a printing sheet 14 on a platen 1 of this apparatus, a carriage 3 is first moved along a guide shaft 2 and a printing line on the platen 1 to its printing point, with a holder 5 kept in a printable position indicated by the full line in FIG. 1. Then, a specific one of the type elements 7*a* on a type carrier 7, formed of a daisy wheel, is selected and opposed to the printing point on the platen 1, by means of a type selection motor 6 on the holder 5. The selected type element 7*a* is struck by a printing hammer 8*a*. The hammer 8*a* is operated by means of a hammer driver 8 which is supported on a top bent portion 5*a* of the holder 5. In replacing the type carrier 7, moreover, the holder 5 is moved from a printable position, where it is situated close to the platen 1, to a retracted position indicated by the two-dot chain line in FIG. 1. The holder 5 is also slidably mounted on the guide shaft 2. The type carrier 7 is mounted on a rotating shaft 6*a* of the motor 6.

In a printing operation, the selected type element 7*a* is struck against the printing sheet 14 on the platen 1 by the printing hammer 8*a* in a manner such that a ribbon 13 drawn out of a ribbon cassette 9 is interposed between the element 7*a* and the sheet 14. In shifting the holder 5 between the printable position and the retracted position, an operator holds and operates a shift lever 10 attached to the holder 5.

In the prior art printing apparatus described above, the holder 5, which is formed by pressing an iron plate, is provided with an integral coupling projection 11 having a guide groove 11*a*. The groove 11*a*, which is open at one end, extends at right angles to the carriage transfer direction. A raised piece 12 is formed integrally on one side of the carriage 3, which also is formed by pressing an iron plate. The raised piece 12 and the guide groove 11*a* constitute coupling means for connecting the carriage and the holder. As the piece 12 and the groove 11*a* engage each other, the holder 5 is allowed, to move between the printable position and the retracted position. In the carriage transfer direction, the holder 5 is moved in one with the carriage 3. Since the raised piece 12 is a thin plate, however, the engagement between its engaging portion and the guide groove 11*a* lacks stability. Thus, the raised piece 12 and the guide groove 11*a* are subject to play between them, so that the carriage 3 and the type element 7*a* are liable to be dislocated from each other. Part of a wire 4, which is used to apply a driving force to the carriage 3, is fixed to an anchor portion 3*a* located substantially in the center of the carriage 3 and off the raised piece 12. If the tractive force of the wire 4 is applied to the carriage 3 in the carriage transfer direction indicated by the arrow, the raised piece 12 may possibly bend, as indicated by the two-dot chain line in FIG. 2, due to the low rigidity of the piece 12, the force of inertia of the holder 5 and the type carrier 6 thereon, and frictional resistance between the holder 5 and the guide shaft 2. Accordingly, the dislocation between the carriage 3 and the holder 5, i.e., between the carriage 3 and the type element 7*a*, increases, so that the printing pitches become irregular, thus lowering the print quality.

Meanwhile, if the rigidity of the carriage 3 is increased by thickening its wall or by additionally providing a reinforcing member, in order to prevent the raised piece 12 from bending, the carriage 3 becomes heavier in weight. Thus, a drive source with a greater driving force must be used, possibly entailing an increase in manufacturing costs, as well as in size, and preventing high-speed printing operation.

SUMMARY OF THE INVENTION

The present invention has been developed in consideration of these problems, and it is an object of the invention to provide a printing apparatus, in which the rigidity of the junction between a carriage and a holder can be increased without entailing an increase in weight of moving parts, including the carriage and the holder, thereby preventing dislocation between these two members, so that high-accuracy, high-quality printing can be effected at high speed without irregularity in printing pitches.

In order to achieve the above object, according to the present invention, there is provided a printing apparatus which basically comprises coupling means disposed between a carriage and a holder and serving to connect the carriage and the holder for united movement in a carriage transfer direction. With respect to a direction substantially transverse to the carriage transfer direction, the coupling means allows the holder to move relatively to the carriage, so that the holder can move freely between a printable position close to a platen and a retreated position wide apart from the platen. The coupling means includes a coupling plate attached to one of the holder and the carriage and having a surface extending substantially along the carriage transfer direction, an opening formed in the coupling plate, and an engaging member attached to the other of the two members and extending transverse to the carriage transfer direction so as to engage the opening.

With this arrangement, play between the carriage and the holder can be prevented during the movement of the carriage, so that the united movement of these two members in the carriage transfer direction can be secured, thus permitting high-accuracy printing without irregularity in printing pitches.

In a preferred specific arrangement of the present invention, the engaging member is formed of a lug having a surface extending along the carriage transfer direction, the lug having a predetermined width along the carriage transfer direction, while the opening of the coupling plate has a width substantially equal to the width of the lug, with respect to the carriage transfer direction.

With this arrangement, a force from the coupling plate is applied to the lug, not across its thickness but across its width. Even though formed of a thin plate, therefore, the lug can be strong enough for the purpose. Thus, the carriage or the holder need not be increased in thickness to ensure its rigidity, so that the weight of the whole moving parts can be reduced. Also, a small-sized drive motor or the like can be used as a drive source, which facilitates reduction in cost and compact design.

These and other objects and advantages of the present invention will become more apparent and will be better understood with reference to the following detailed description taken in conjunction with the accompanying drawings.

DETAILED DESCRIPTION OF THE PREFERRED EMBODIMENT

Figure 3:
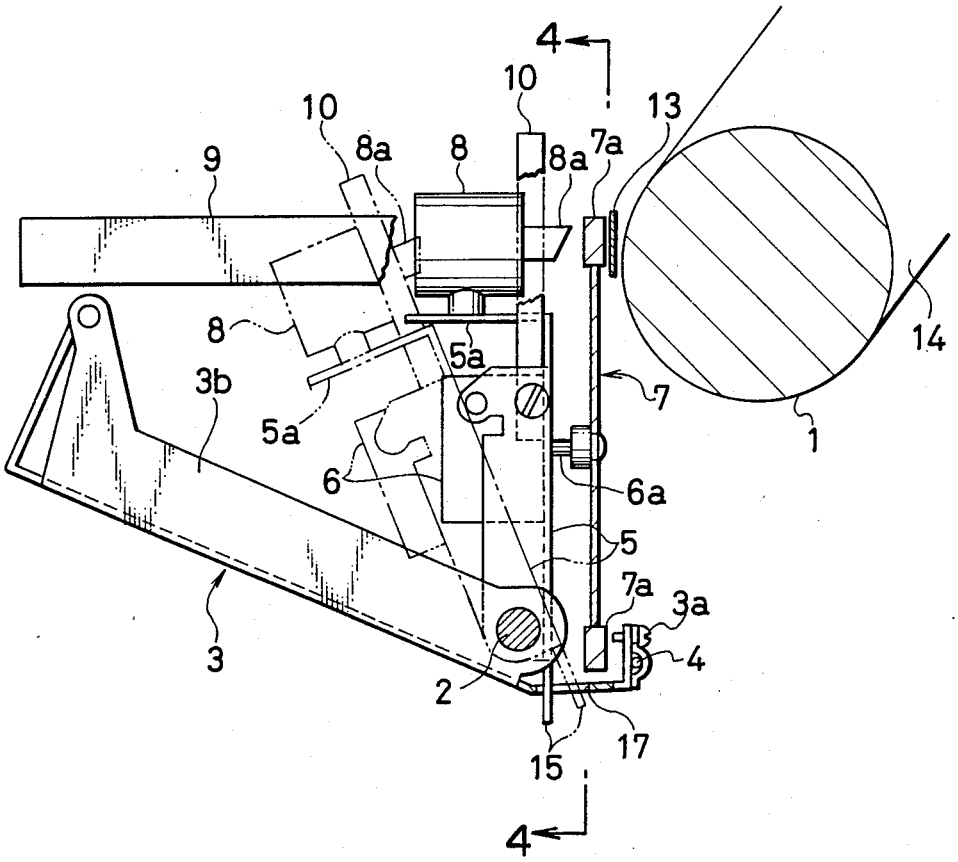
FIG. 3 is a cutaway side view of a printing apparatus according to an embodiment of the present invention.
Figure 4:
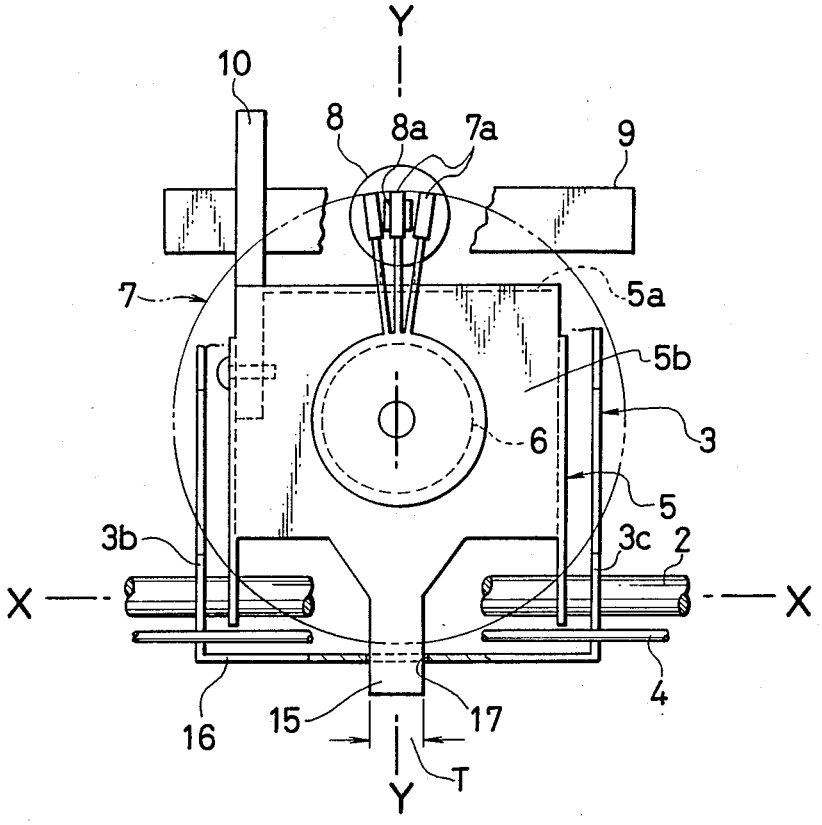
FIG. 4 is a cutaway front view taken along line 4—4 of FIG. 3.

Referring now to FIGS. 3 and 4, an embodiment of the present invention will be described in detail.

In the accompanying drawings, like reference numerals refer to the same parts throughout the several views.

In a printing apparatus according to this embodiment, as shown in FIG. 3, a platen 1 is rotatably attached to a housing (not shown) of the apparatus. A guide shaft 2 and a guide rail (not shown) extend parallel to each other along a printing line on the platen 1. A carriage 3 is mounted on the guide shaft 2 and the guide rail so as to be movable along the printing line, in a carriage transfer direction indicated by a line X—X in FIG. 4. The carriage 3 is formed by bending a metal plate. Below the platen 1, an endless wire 4 is passed around driving and driven pulleys (not shown). The wire 4, which constitutes an elongated flexible drive member, can travel parallel to the platen 1. Part of the wire 4 is fixedly clamped by means of a front anchor portion 3*a* of the carriage 3. As the wire 4 is run by a carriage drive motor (not shown), which is coupled to the driving pulley, the carriage 3 reciprocates along the platen 1.

A holder 5, which is formed by bending a metal plate, is disposed inside the carriage 3. The proximal end portion of the holder 5 is supported on the guide shaft 2 so that the holder 5 can both swing around and slide along the shaft 2. The holder 5 can be swung between a printable position, where the holder 5 is opposed close to the platen 1, as indicated by the full line in FIG. 3, and a retracted position, where the holder 5 is kept wide apart from the platen 1, as indicated by the two-dot chain line in FIG. 3.

The holder 5 includes a top bent portion 5*a*, a planar holder body 5*b*, an engaging member 15 (mentioned later), and a pair of side plates 5*c* and 5*d* whose proximal end portions slidably engage the guide shaft 2. All these portions or members are formed integrally from one metal plate by pressing.

A type selection motor 6, for use as a type selection device, is fixed to one side face of the body 5*b* of the holder 5, and its output shaft 6*a* penetrates the holder 5 and projects to the platen side. A type wheel or daisy wheel 7 is removably mounted on the output shaft 6*a*. The wheel 7, which constitutes a type carrier, has a number of type elements 7*a* arranged along its outer periphery. A solenoid 8 is fixed to the top bent portion 5*a* of the holder 5. The solenoid 8, which constitutes a hammer driver, is provided with a printing hammer 8*a* which serves to strike the type elements 7*a*. Further, a ribbon cassette 9, containing a printing ribbon 13 therein, is mounted on a cassette holder (not shown), which is located over the carriage 3. Part of the printing ribbon 13 is situated between the type elements 7*a* and the platen 1 for traveling. A shift lever 10 is fixed to one side portion of the holder 5 so as to project upward. The lever 10 is used to shift the location of the holder 5 between the printable position and the retracted position. When the lever 10 is in the position indicated by the full line in FIG. 3, the holder 5 is in the printable position. When the lever 10 is moved to the position indicated by the two-dot chain line, the location of the holder 5 is shifted to the retracted position.

A printing sheet 14 is wound on the platen 1, and is subjected to a printing operation using the ribbon 13 and the type wheel 7.

The carriage 3 includes a pair of side plates 3*b* and 3*c*, whose proximal end portions are slidably supported on the guide shaft 2, and a coupling plate 16 integrally connecting the respective proximal ends of the side plates 3*b* and 3*c*. The carriage 3 is formed from one metal plate by pressing.

The surface of the coupling plate 16 extends parallel to the carriage transfer direction X—X. A rectangular opening 17, for use as a coupling hole, is bored through the middle portion of the coupling plate 16, in a transverse direction Y—Y crossing the carriage transfer direction X—X at right angles. The opening 17, in conjunction with the engaging member 15, constitutes coupling means between the carriage 3 and the holder 5.

The engaging member 15 protrudes, in the form of an integral lug, in the transverse direction Y—Y from the lower end portion of the holder body 5*b* or from the opposite side of the holder 5 to the top bent portion 5*a*. The surface of the engaging member 15 extends along the carriage transfer direction X—X. A width T or the length of the engaging member 15 in the direction X—X is made substantially equal to or a little smaller than the width of the opening 17 in the same direction so that the member 15 is fitted tight in the opening 17.

Thus, with respect to the carriage transfer direction X—X, the carriage 3 and the holder 5 move as one. With respect to the transverse direction Y—Y, on the other hand, the engaging member 15 is allowed to swing freely around the guide 2 within the opening 17, between the printable position and the retracted position, as shown in FIG. 3, since the opening 17 is elongated crosswise.

As shown in FIG. 4, the carriage 3 and the holder 5 each have a symmetrical configuration with respect to a transverse line passing through the center of the type wheel 7, i.e., the center line Y—Y. The engaging member 15 extends along the center line Y—Y, while the opening 17 is situated on the line Y—Y. Thus, the coupling means is situated in the center of the assembly consisting of the holder and the carriage. Whether the carriage 3 advances or retreats in its transfer direction X—X, therefore, a force is transmitted from the carriage 3 to the holder 5 in a uniform manner without any deviation with respect to the transfer direction.

As seen from FIG. 3, the location of engagement between the engaging member 15 and the opening 17 is situated on the same side of the guide shaft 2 as the anchor portion 3*a* for the wire 4 and between the guide shaft 2 and the anchor portion 3*a*. Thus, the engagement location is situated close to the guide shaft 2, so that the force from the carriage 3 is transmitted smoothly to the holder 5 without substantially twisting the holder 5.

At the start of a printing operation using the printing apparatus of this embodiment, the carriage drive motor 6 is first actuated with the holder 5 kept in the printable position indicated by the full line in FIG. 3. Thereupon, the driving force of the motor 6 is transmitted to the carriage 3 by means of the wire 4, so that the carriage 3 is moved in the carriage transfer direction X—X. Meanwhile, as the engaging member 15 is fitted in the opening 17, the holder 5 is moved as one with the carriage 3. After the carriage 3 is moved to a predetermined position for printing, a specific type element *7a* is selected by means of the type selection motor 6 and opposed to a printing point on the platen 1. Subsequently, the selected type element *7a* is struck against the printing ribbon 13 by the printing hammer *8a*, whereupon a character or the like is printed on the printing sheet 14.

Figure 1:
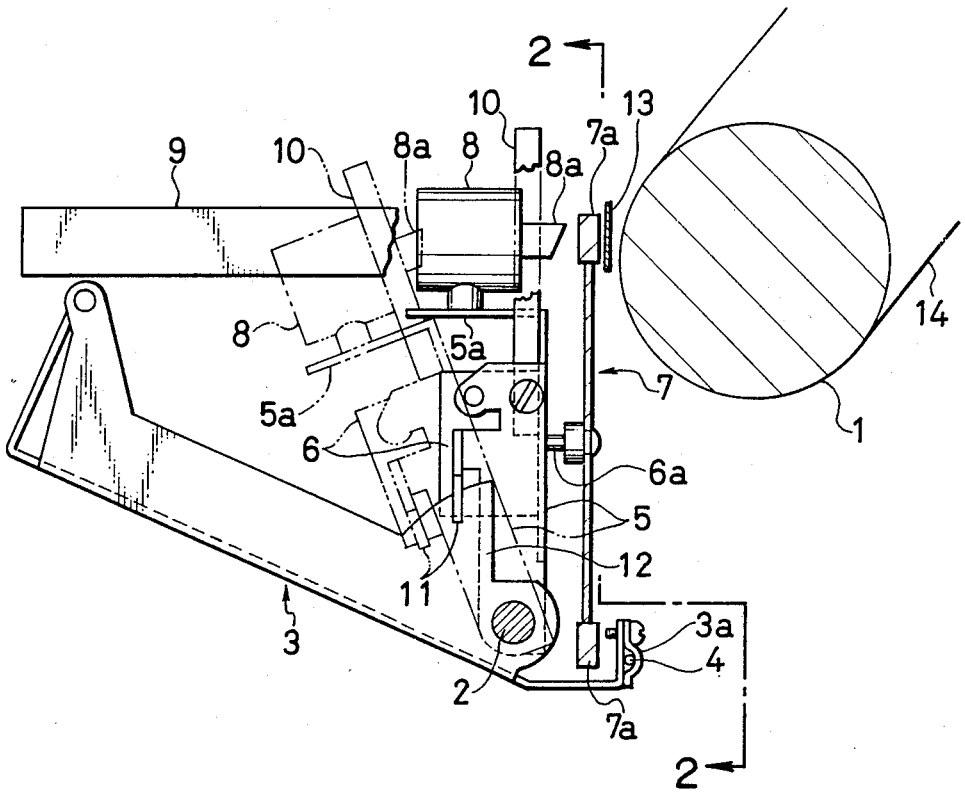
FIG. 1 PRIOR ART
FIG. 1 is a cutaway side view of a prior art printing apparatus.
Figure 2:
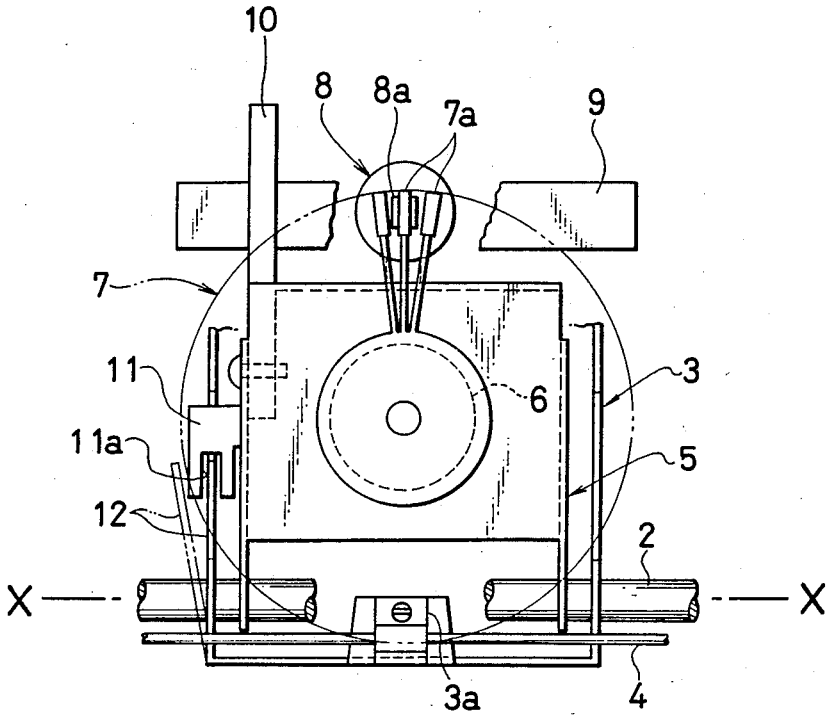
FIG. 2 PRIOR ART
FIG. 2 is a cutaway front view taken along line 2—2 of FIG. 1.

In replacing the type wheel 7, the holder 5 is rocked rearward from the printable position by means of the shift lever 10, with the carriage 3 at a standstill. Thereupon, the engaging member 15 is moved forward within the opening 17, so that the holder 5 is allowed to shift its position to the retreated position. Then, the type wheel 7 can be replaced with another one by being removed from the output shaft *6a*, with the holder 5 in the retracted position Thereafter, the lever 10 is operated again to return the holder 5 to the printable position In this embodiment, as described above, the engaging member 15 fitted in the opening 17 has a width substantially equal to that of the opening 17. Unlike the engagement between the raised piece 12 and the guide groove 11*a* in the prior art arrangement shown in FIGS. 1 and 2, therefore, the engagement between the engaging member 15 and the opening 17 can prevent the carriage 3 and the holder 5 from suffering play during the movement of the carriage 3. Thus, the carriage 3 and the holder 5 can be securely moved as one. Since the junction between the engaging member 15 and the opening 17 is situated close to that between the carriage 3 and the wire 4, the tractive of the wire 4 can be securely transmitted to the carriage 3 and the holder 5. Thus, power loss can be reduced. Moreover, the engaging member 15 has a predetermined width along the carriage transfer direction, and its side edges engage their corresponding inner side edges of the opening 17, which is formed within a plane parallel to the carrier transfer direction, so that the engaging member 15 and the opening 17 are coupled to each other. Accordingly, the engaging member 15 cannot be deformed even though the carriage 3 is subjected to a large tensile force, applied through the wire 4, and the force of inertia of the holder 5, acting in the direction opposite to the direction of the tensile force, when the transfer direction of the carriage 3 is reversed, in particular. As a consequence, the carriage 3 and the type elements *7a* cannot be dislocated with respect to each other, so that high-accuracy printing can be effected without entailing irregular printing pitches.

In this embodiment, moreover, the rigidity of the junction is improved by the use of a simple arrangement such that the engaging member 15 is only fitted in the opening 17. It is unnecessary, therefore, to thicken the wall of the carriage or the holder, thereby increasing the total weight of the carriage, in order to maintain the rigidity. Thus, the carriage drive motor used need not be able to produce a great driving force, so that an increase in manufacturing costs can be prevented.

It is to be understood that the present invention is not limited to the embodiment described above, and that various changes and modifications may be effected therein by one skilled in the art without departing from the scope or spirit of the invention.

For example, the opening and the engaging member fitted therein can be provided in the sides of the holder and the carriage, respectively, and vice versa. Moreover, the carriage may be moved by means of a timing belt.

In the embodiment described above, moreover, the type wheel 7, which constitutes part of a printing means, is mounted on the holder 5 so as to be rockable together therewith between the printable position and the retracted position. Alternatively, however, the type wheel 7 may be removably mounted on a predetermined mounting position on the carriage 3. When the holder 5 is in the printable position, in this modification, the shaft *6a* engages the wheel 7 to transmit a rotatory force thereto. When the holder 5 is rocked to the retracted position, the shaft *6a* is disengaged from the wheel 7. The engagement and disengagement between the shaft 6 and the wheel 7 are effected by means of conventional coupling means.

In the case of the above modification, moreover, the type wheel may be housed in a cassette which, having a wheel bearing, can be removably mounted on the carriage.

What is claimed is:

1. A printing apparatus, comprising: a platen;

a carriage movable in a carriage transfer direction along a printing line extending along the longitudinal direction of the platen;

printing means including a type carrier movable with the carriage and having a number of type elements, said type elements being located selectively at a printing point on the platen for printing operation;

a holder bearing at least part of the printing means thereon and swingable between a printing position, situated close to the platen, in order to allow the printing means to perform the printing operation, and a retracted position which is situated wide apart from the platen;

said carriage and said holder being slidably supported on a common guide shaft extending in the carriage transfer direction, said swingable movement of said holder being effected around said common guide shaft;

coupling means for connecting the holder and the carriage, said coupling means causing the holder to move as one with the carriage, in the carriage transfer direction along the printing line, and allowing the holder to move relatively to the carriage, in a direction transverse to the carriage transfer direction between the printing position and the retracted position;

said coupling means including a coupling plate attached to one of the holder and the carriage and having a surface substantially parallel to the carriage transfer direction, an opening formed in the coupling plate, and a plate like engaging member attached to the other of the holder and the carriage and extending transverse to the carriage transfer direction so as to engage the opening:

said engaging member having a surface extending along the carriage transfer direction and a predetermined width along the carriage transfer direction; and said opening of said coupling plate having a width in the carriage transfer direction substantially equal to the width of the engaging member.

2. The printing apparatus according to claim 1, wherein said printing means further includes type selection means for operating the type carrier so as to locate the type elements of the type carrier selectively at the printing point on the platen, said type selection means being mounted on the holder.

3. The printing apparatus according to claim 2, wherein said type carrier is removably supported on the carriage so that the type carrier is allowed to be mounted on or removed from the carriage when the holder is shifted to the retracted position.

4. The printing apparatus according to claim 2, wherein said type carrier is removably supported on the holder so that the type carrier is allowed to be mounted on or removed from the holder when the holder is shifted to the retracted position.

5. The printing apparatus according to claim 1, wherein said engaging member and said coupling plate are attached to holder and the carriage, respectively.

6. The printing apparatus according to claim 5, wherein said carriage has a mounting end for an elongated flexible drive member for driving the carriage in the carriage transfer direction, and engagement between said engaging member and said opening of the coupling plate is done on the same side of the guide shaft as the mounting end.

7. The printing apparatus according to claim 5, wherein said holder includes a holder body formed of a planar member, said engaging member being formed integrally with the holder body.

8. The printing apparatus according to claim 7, wherein said carriage includes a pair of side plates, said coupling plate being formed integrally with the side plates.

9. The printing apparatus according to claim 8, wherein said holder and said carriage are each substantially symmetrical with respect to a center line passing through the center of the type carrier on the holder and extending substantially at right angles to the carriage transfer direction, said engaging member and said opening of the coupling plate being situated on the center line.

10. The printing apparatus according to claim 9, wherein said opening is a rectangular hole formed in the coupling plate.

* * * * *